US008506308B2

(12) United States Patent
Asano et al.

(10) Patent No.: US 8,506,308 B2
(45) Date of Patent: Aug. 13, 2013

(54) SUBSTRATE CONNECTION STRUCTURE

(75) Inventors: Hiroaki Asano, Kariya (JP); Sadanori Suzuki, Kariya (JP); Kiminori Ozaki, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 43 days.

(21) Appl. No.: 13/345,433

(22) Filed: Jan. 6, 2012

(65) Prior Publication Data

US 2012/0178313 A1 Jul. 12, 2012

(30) Foreign Application Priority Data

Jan. 11, 2011 (JP) ..... 2011-003331

(51) Int. Cl.
*H01R 12/00* (2006.01)

(52) U.S. Cl.
USPC ..... 439/74

(58) Field of Classification Search
USPC ..... 439/74, 65
See application file for complete search history.

(56) References Cited

U.S. PATENT DOCUMENTS

| | | | | |
|---|---|---|---|---|
| 3,812,381 | A * | 5/1974 | Guyton | 361/803 |
| 5,345,366 | A * | 9/1994 | Cheng et al. | 361/785 |
| 6,859,370 | B1 * | 2/2005 | Hsu et al. | 361/752 |
| 6,955,544 | B2 * | 10/2005 | Miquel et al. | 439/76.1 |
| 7,104,805 | B2 * | 9/2006 | Hjort et al. | 439/74 |
| 2005/0052853 | A1 * | 3/2005 | Hsu et al. | 361/752 |

FOREIGN PATENT DOCUMENTS

| | | | |
|---|---|---|---|
| JP | 08-321337 | A | 12/1996 |
| JP | 10-262370 | A | 9/1998 |
| JP | 2007-060882 | A | 3/2007 |

* cited by examiner

*Primary Examiner* — Gary F. Paumen
(74) *Attorney, Agent, or Firm* — Sughrue Mion, PLLC

(57) ABSTRACT

A substrate connection structure includes a first substrate, a second substrate, a first connection terminal plate, a second connection terminal plate, and a fastening member. The first connection terminal plate extends away from the first substrate and includes a flat portion. The second connection terminal plate extends away from the second substrate and includes a flat portion. At least one of the flat portions includes a screw insertion portion. The fastening member fastens the first connection terminal plate and the second connection terminal plate through the screw insertion portion in a state in which the flat portions are in contact with each other.

5 Claims, 7 Drawing Sheets

SUBSTRATE CONNECTION STRUCTURE

BACKGROUND OF THE INVENTION

The present invention relates to a substrate connection structure for electrically connecting a first substrate and a second substrate.

To connect two substrates with each other, a connector may be arranged on each substrate, and the two connectors may be connected to each other by a harness (refer to, for example, Japanese Laid-Open Patent Publication No. 10-262370). Alternatively, the two connectors may be directly connected to each other (refer to, for example, Japanese Laid-Open Patent Publication No. 2007-60882).

However, the connectors connecting the substrates are not applicable to large currents. Further, the use of the harness and connectors to connect the substrate lowers the efficiency for coupling components.

SUMMARY OF THE INVENTION

It is an object of the present invention to provide a substrate connection structure that is applicable to large currents and allows for efficient coupling of components.

One aspect of the present invention is a substrate connection structure provided with a first substrate including two opposite surfaces. A semiconductor element is mounted on at least one of the two surfaces. A second substrate faces the first substrate and includes two opposite surfaces. A semiconductor element is mounted on at least one of the two surfaces. A first connection terminal plate extends away from the first substrate. The first connection terminal plate includes a basal end, which is fixed to the first substrate, and a flat portion. A second connection terminal plate extends away from the second substrate. The second connection terminal plate includes a basal end, which is fixed to the second substrate, and a flat portion. At least one of the flat portions includes a screw insertion portion. A fastening member fastens the first connection terminal plate and the second connection terminal plate through the screw insertion portion in a state in which the flat portions are in contact with each other.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

One embodiment of the present invention will now be described with reference to the drawings.

Figure 1A:
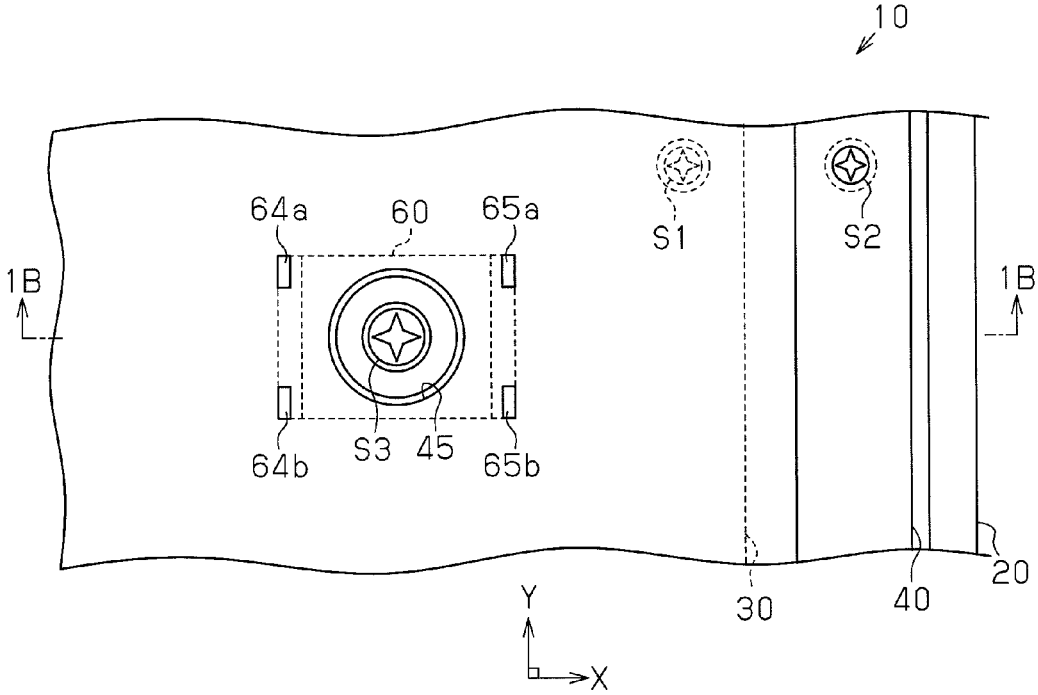
FIG. 1A is a plan view showing an electronic device according to one embodiment of the present invention.
Figure 1B:
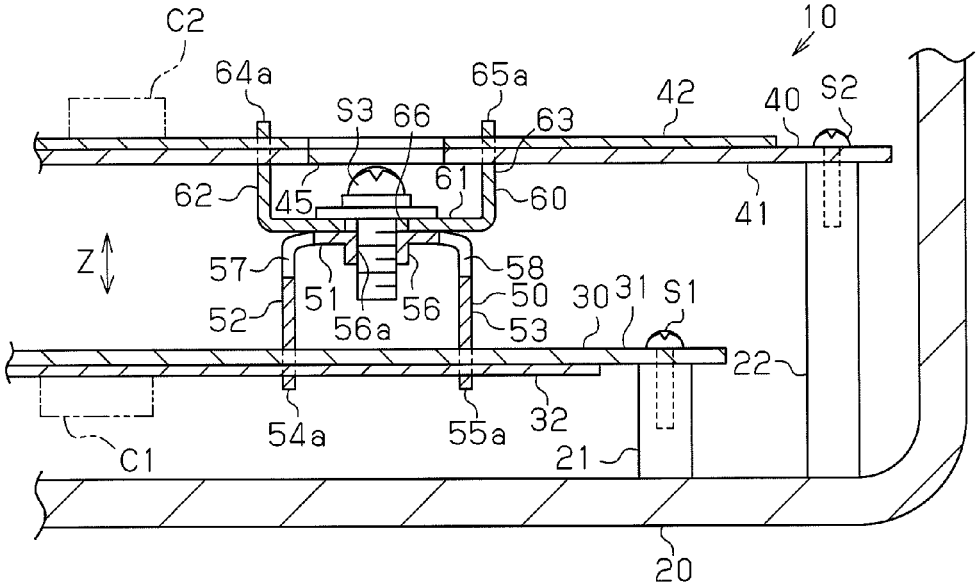
FIG. 1B is a cross-sectional view taken along line 1B-1B in FIG. 1A.

As shown in FIGS. 1A and 1B, the electronic device 10 includes a case 20 that accommodates a first printed substrate 30, serving as a first substrate, and a second printed substrate 40, serving as a second substrate. The first printed substrate 30 includes two opposite surfaces. A semiconductor element C1 is mounted on one of the two surfaces (refer to FIG. 1B). The second printed substrate 40 also includes two opposite surfaces. A semiconductor element C2 is mounted on one of the two surfaces (refer to FIG. 1B). The first printed substrate 30 and second printed substrate 40 face toward each other.

The first printed substrate 30 and the second printed substrate 40 are electrically connected to each other. A first terminal base 50, which is arranged on the first printed substrate 30, and a second terminal base 60, which is arranged on the second printed substrate 40, are fastened to each other to connect the substrates 30 and 40. The first terminal base 50, which serves as a first connection terminal plate, is formed from a U-shaped plate. The second terminal base 60, which serves as a second connection terminal plate, is formed from a U-shaped plate.

A substrate connection structure will now be described.

As shown in FIG. 1B, the first printed substrate 30 includes an insulation substrate 31 and a conductor 32. The conductor 32 is formed on one surface (lower surface) of the insulation substrate 31. The conductor 32 is patterned into a predetermined shape.

Cylindrical supports 21 are arranged on a bottom surface of the case 20. The first printed substrate 30 is horizontally arranged on the cylindrical supports 21. A screw S1, which extends through the insulation substrate 31, is fastened to each cylindrical support 21 to fix the first printed substrate 30.

The second printed substrate 40 includes an insulation substrate 41 and a conductor 42. The conductor 42 is formed on one surface (upper surface) of the insulation substrate 41. The conductor 42 is patterned into a predetermined shape. The second printed substrate 40 is horizontally arranged on cylindrical supports 22, which extend from the bottom surface of the case 20. A screw S2, which extends through the insulation substrate 41, is fastened to each cylindrical support 22 to fix the second printed substrate 40. The second printed substrate 40 is opposed to and arranged above the first printed substrate 30. Further, the second printed substrate 40 is spaced apart by a constant distance from the first printed substrate 30.

Figure 2:
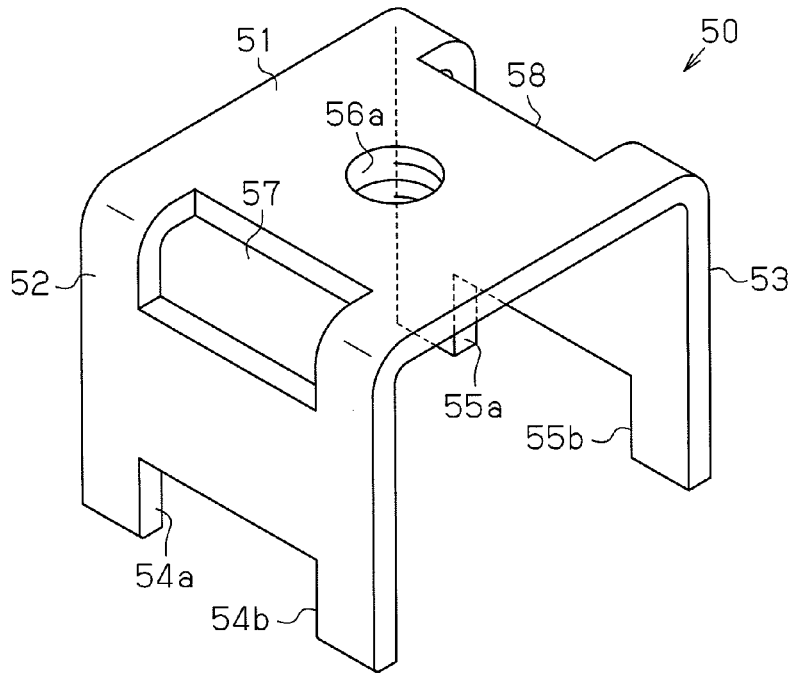
FIG. 2 is a perspective view showing a first connection terminal plate of FIG. 1B.
Figure 4A:
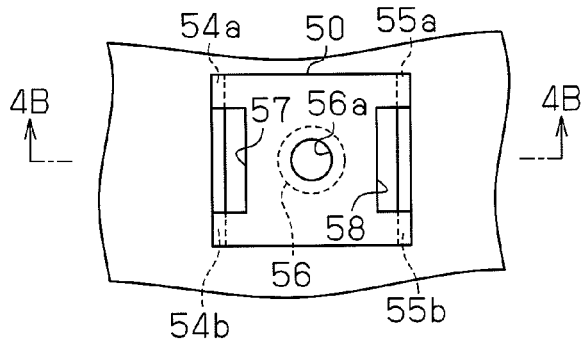
FIG. 4A is a plan view showing a component for a first printed substrate of FIG. 1B.
Figure 4B:
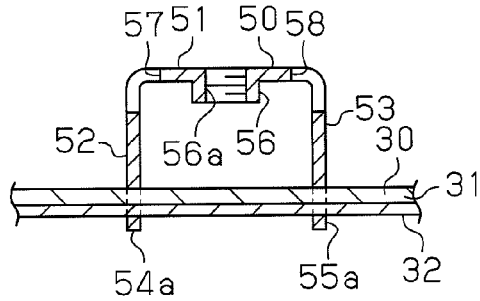
FIG. 4B is a cross-sectional view taken along line 4B-4B in FIG. 4A.

The first terminal base 50, which is arranged on the first printed substrate 30, is formed by bending a metal plate. As shown in FIG. 2, the first terminal base 50 includes a tetragonal horizontal portion 51, a first vertical portion 52, a second vertical portion 53, two projections 54*a* and 54*b*, two projections 55*a* and 55*b*, and a cylindrical portion 56 (refer to FIG. 4). The first vertical portion 52 is bent by 90 degrees from one side of the horizontal portion 51, and the second vertical portion 53 is bent by 90 degrees from the opposite side of the horizontal portion 51. The two projections 54*a* and 54*b* project from an end of the first vertical portion 52. The two projections 55*a* and 55*b* project from an end of the second vertical portion 53.

The horizontal portion 51 of the first terminal base 50 extends in the horizontal direction. The first vertical portion 52 extends downward from one side of the horizontal portion 51. The second vertical portion 53 extends downward from the other side of the horizontal portion 51. The two projections 54*a* and 54*b* extend downward from opposite sides of the lower surface of the first vertical portion 52. The two projections 55*a* and 55*b* extend downward from opposite sides of the lower surface of the second vertical portion 53.

The two projections 54*a* and 54*b* and two projections 55*a* and 55*b* of the first terminal base 50 are passed through the first printed substrate 30 and soldered and fixed to the first printed substrate 30. The first terminal base 50 is electrically connected to the first printed substrate 30. Further, the first terminal base 50 extends upward toward the second printed substrate 40.

The cylindrical portion 56 (refer to FIGS. 4A and 4B) is formed in the central part of the horizontal portion 51 and extends downward from the horizontal portion 51. A threaded hole 56*a*, which receives a screw S3, extends through the cylindrical portion 56.

In this manner, a basal end of the first terminal base 50 is fixed to the printed substrate 30. The first terminal base 50 extends away from first printed substrate 30 and includes the horizontal portion 51, which serves as a flat portion. In detail, the first terminal base 50 includes the vertical portions 52 and 53, which serve as a first portion and extend from the basal end toward the second printed substrate 40, and the horizontal portion 51, which serves as a second portion and forms the flat portion that extends between the distal ends of the vertical portions 52 and 53 in a direction parallel to the first printed substrate 30.

As shown in FIG. 2, the first terminal base 50 includes a slot 57 formed in the middle of the bent part between the horizontal portion 51 and the first vertical portion 52. In the same manner, a slot 58 is formed in the middle of the bent part between the horizontal portion 51 and the second vertical portion 53.

Figure 3:
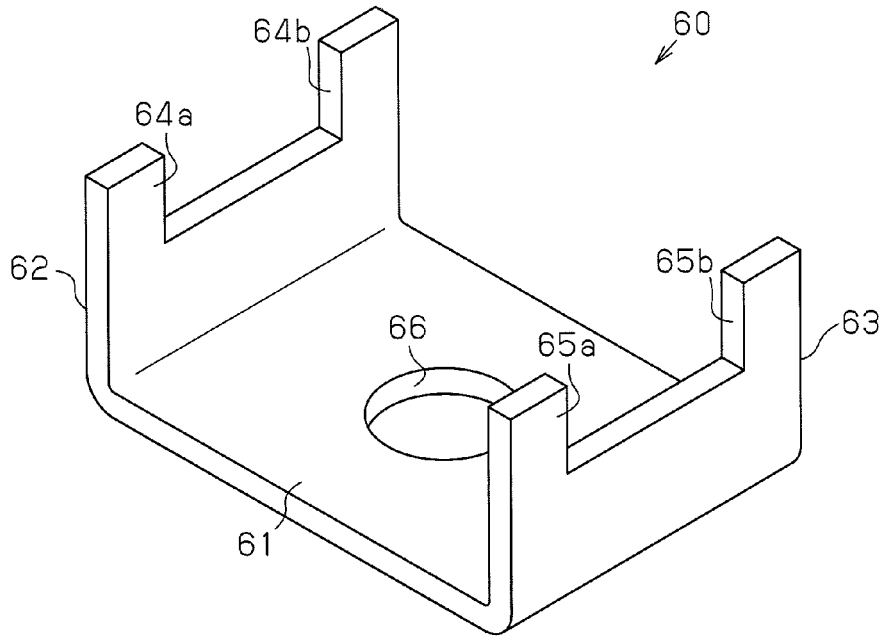
FIG. 3 is a perspective view showing a second connection terminal plate of FIG. 1B.

As shown in FIG. 1, the second printed substrate 40 includes the second terminal base 60. The second terminal base 60 is formed by bending a metal plate. As shown in FIG. 3, the second terminal base 60 includes a tetragonal horizontal portion 61, a first vertical portion 62, a second vertical portion 63, two projections 64*a* and 64*b*, and two projections 65*a* and 65*b*. The first vertical portion 62 is bent by 90 degrees from one side of the horizontal portion 61, and the second vertical portion 63 is bent by 90 degrees from the opposite side of the horizontal portion 61. The two projections 64*a* and 64*b* project from an end of the first vertical portion 62. The two projections 65*a* and 65*b* project from an end of the second vertical portion 63.

The horizontal portion 61 of the second terminal base 60 extends in the horizontal direction. The first vertical portion 62 extends upward from one side of the horizontal portion 61. The second vertical portion 63 extends downward from the other side of the horizontal portion 61. The two projections 64*a* and 64*b* extend upward from the two opposite ends at the upper surface of the first vertical portion 62. The two projections 65*a* and 65*b* extend upward from the two opposite ends at the upper surface of the second vertical portion 63.

The two projections 64*a* and 64*b* and two projections 65*a* and 65*b* of the second terminal base 60 are extended through the second printed substrate 40 and soldered and fixed to the second printed substrate 40. The second terminal base 60 is electrically connected to the second printed substrate 40. Further, the second terminal base 60 extends downward toward the second printed substrate 40.

A screw insertion hole 66, which serves as a screw insertion portion, is formed in the central part of the horizontal portion 61. The screw S3 is inserted through the screw insertion hole 66.

As shown in FIGS. 1A, 1B, 5A, and 5B, a through hole 45 extends through the second printed substrate 40 at a portion corresponding to the horizontal portion 61. The screw S3 can be inserted through the through hole 45 toward the first terminal base 50.

As shown in FIGS. 1A and 1B, the screw S3 is inserted through the screw insertion hole 66 and engaged with the threaded hole 56*a*. In other words, the screw S3 fastens the first terminal base 50 and the second terminal base 60 through the screw insertion hole 66. In this state, the horizontal portions 51 and 61 are in contact with each other. Thus, the fastening of the first terminal base 50 and second terminal base 60 with the screw S3 connects the substrates 30 and 40.

As shown in FIG. 3, the screw insertion hole 66, through which the screw S3 is inserted as shown in FIG. 1B, has a larger diameter than the threaded hole 56*a* (screw S3). This accommodates coupling tolerances in X and Y directions, which extend in the horizontal direction as indicated in FIG. 1A.

Due to the slots 57 and 58 formed in the first terminal base 50 as shown in FIG. 2, the horizontal portion 51 is movable in the vertical direction. When fastening the substrates to each other, the horizontal portion 51 of the first terminal base 50 can be moved in the vertical direction (Z direction in FIG. 1B), and the coupling tolerance in the vertical direction (Z direction) can be accommodated. For example, as shown in FIG. 6B, a gap (tolerance) may be formed between the horizontal portions 51 and 61 before fastening the substrates to each other. The slots 57 and 58 in the first terminal base 50 are formed to eliminate the gap by lifting the horizontal portion 51, which comes into contact with the second terminal base 60.

The operation of the substrate connection structure will now be described.

When assembling the electronic device 10, the case 20, the first printed substrate 30, and the second printed substrate 40 are prepared. The cylindrical supports 21 and 22 are arranged in the case 20. Elements are arranged on the first printed substrate 30 together with the first terminal base 50. Further, elements are arranged on the second printed substrate 40 together with the second terminal base 60.

Figure 6A:
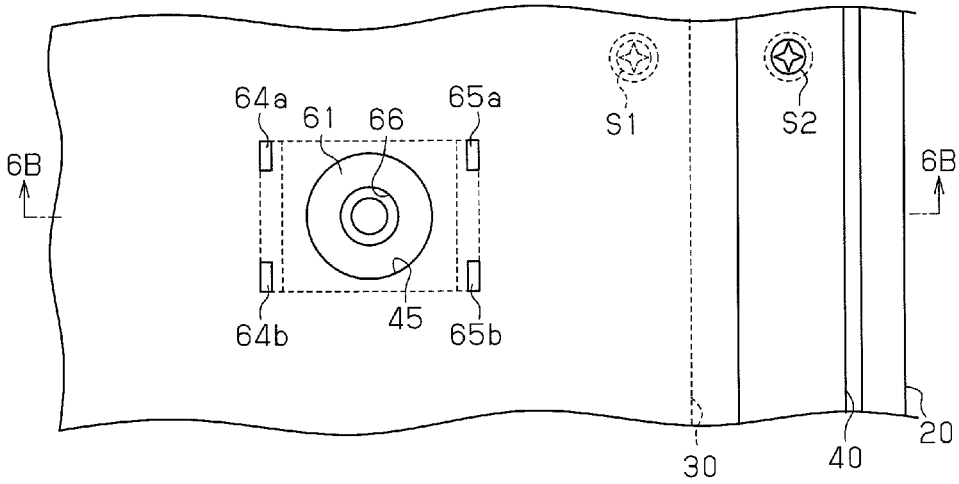
FIG. 6A is a plan view showing the electronic device of FIG. 1B.
Figure 6B:
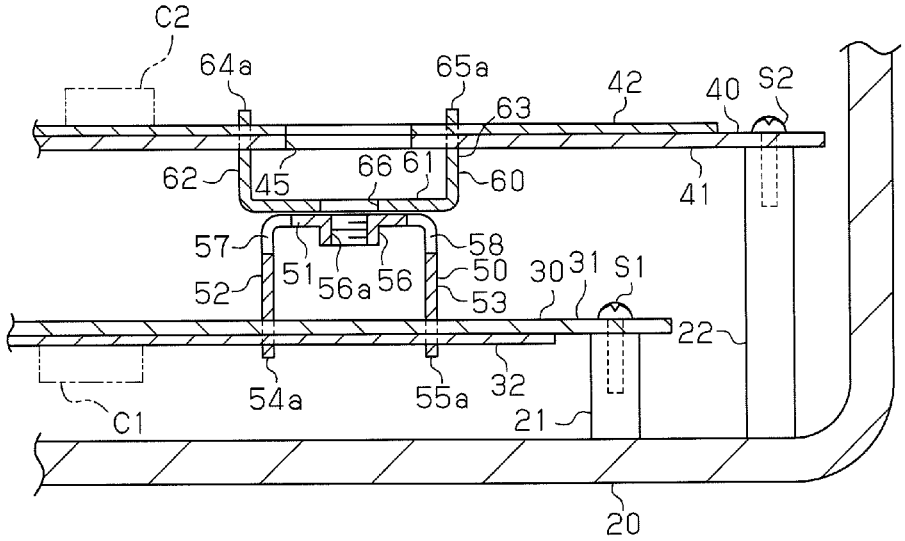
FIG. 6B is a cross-sectional view taken along line 6B-6B in FIG. 6A.

Referring to FIGS. 6A and 6B, the first printed substrate 30 is arranged horizontally on the cylindrical supports 21 of the case 20. Further, the screw S1 is fastened to each cylindrical support 21 to fix the first printed substrate 30. Then, the second printed substrate 40 is arranged horizontally on the cylindrical supports 22 of the case 20. Further, the screw S2 is fastened to each cylindrical support 22 to fix the second printed substrate 40.

In this state, the horizontal portion 51 of the first terminal base 50 is slightly separated from the horizontal portion 61 of the second terminal base 60.

Referring to FIGS. 1A and 1B, the screw S3 is inserted through the screw insertion hole 66 and engaged with the threaded hole 56*a*. This fastens and electrically connects the first terminal base 50 and second terminal base 60. Thus, the first terminal base 50 and second terminal base 60 electrically connect the first printed substrate 30 and second printed substrate 40.

The above embodiment has the advantages described below.

(1) The substrate connection structure includes the first printed substrate 30, the second printed substrate 40, the first terminal base 50 that serves as the first connection terminal plate, the second terminal base 60 that serves as the second connection terminal plate, and the screw S3 that serves as a fastening member. The first terminal base 50 includes a basal end fixed to the first printed substrate 30. The first terminal base 50 extends away from the first printed substrate 30. The second terminal base 60 includes a basal end fixed to the second printed substrate 40. The second terminal base 60 extends away from the second printed substrate 40. The horizontal portion 61 of the second terminal base 60 includes the screw insertion hole 66. In a state in which the horizontal portion 51 of the first terminal base 50 is in contact with the horizontal portion 61 of the second terminal base 60, the screw S3 fastens the first terminal base 50 and the second terminal base 60 through the screw insertion hole 66. Since the horizontal portion 51 of the first terminal base 50 is in contact with the horizontal portion 61 of the second terminal base 60, the substrate connection structure is applicable to large currents. Further, the horizontal portion 51 and horizontal portion 61 come into contact by fastening and connecting the first printed substrate 30 and the second printed substrate 40 with the screw S3. Thus, the substrate connection structure allows for efficient coupling.

In this manner, the terminal bases 50 and 60 are respectively arranged on the corresponding printed substrates 30 and 40. Then, the screw S3 fastens and connects the terminal bases 50 and 60. This enlarges the area of contact between the terminal bases 50 and 60 and allows for a connection applicable to large currents.

More specifically, in the prior art, there are no connectors that are applicable to high currents and connect substrates. In the present embodiment, however, the first terminal base 50 and the second terminal base 60 are in planar contact, in which flat surfaces are in contact with each other. Thus, the substrate connection structure of the present embodiment is applicable to high currents.

In the prior art, when a harness connects connectors, the efficiency for coupling components is lowered. In contrast, in the present embodiment, the first terminal base 50 and second terminal based 60 are connected just by stacking and fastening them. This increases the efficiency for coupling components.

Further, in the prior art, the harness has a tendency to be long to improve workability. However, this results in electrical losses. In the present embodiment, the first printed substrate 30 and the second printed substrate 40 are electrically connected by the terminal bases 50 and 60, which join the two substrates 30 and 40 with the minimum distance. This minimizes electrical losses.

(2) One of the first terminal base 50 and the second terminal base 60, namely, the second terminal base 60, includes the screw insertion hole 66. The other one of the first terminal base 50 and the second terminal base 60, namely, the first terminal base 50, includes the threaded hole 56*a*, which receives the screw S3. The screw insertion hole 66 has a larger diameter than the threaded hole 56*a*. This accommodates the coupling tolerance at the surface in which the screw insertion hole 66 is formed.

In the prior art, the coupling tolerance of substrates may hinder coupling. In contrast, the present invention sets the screw insertion hole 66 with a larger diameter than the threaded hole 56*a* (screw S1). This accommodates the coupling tolerance. Since the coupling tolerance can be accommodated, the substrate connection structure is applicable to large currents.

(3) The slots 57 and 58, which are formed in the first terminal base 50, define a tolerance accommodation portion. More specifically, at least one of the first terminal base 50 and second terminal base 60, namely, the first terminal base 50 includes the tolerance accommodation portion that deforms and accommodates tolerance by allowing the first printed substrate 30 and second printed substrate 40 to approach each other. This accommodates the coupling tolerance in a direction in which the first printed substrate 30 and second printed substrate 40 approach each other.

In the prior art, the coupling tolerance of substrates may hinder coupling. In contrast, the present invention forms the slots 57 and 58 in the first terminal base 50 and accommodates the coupling tolerance. Since the coupling tolerance can be absorbed, the substrate connection structure is applicable to large currents.

It should be apparent to those skilled in the art that the present invention may be embodied in many other specific forms without departing from the spirit or scope of the invention. Particularly, it should be understood that the present invention may be embodied in the following forms.

In the present embodiment, the lower first terminal base 50 and the upper second terminal base 60 may be reversed. In this case, slots may be provided in the upper terminal base so that the upper terminal base is movable in the downward direction, and the lower terminal base may be free from slots.

Alternatively, slots may be provided in the upper terminal base so that the upper terminal base is movable in the downward direction, and slots may be provided in the lower terminal base so that the lower terminal base is movable in the upward direction.

Figure 7:
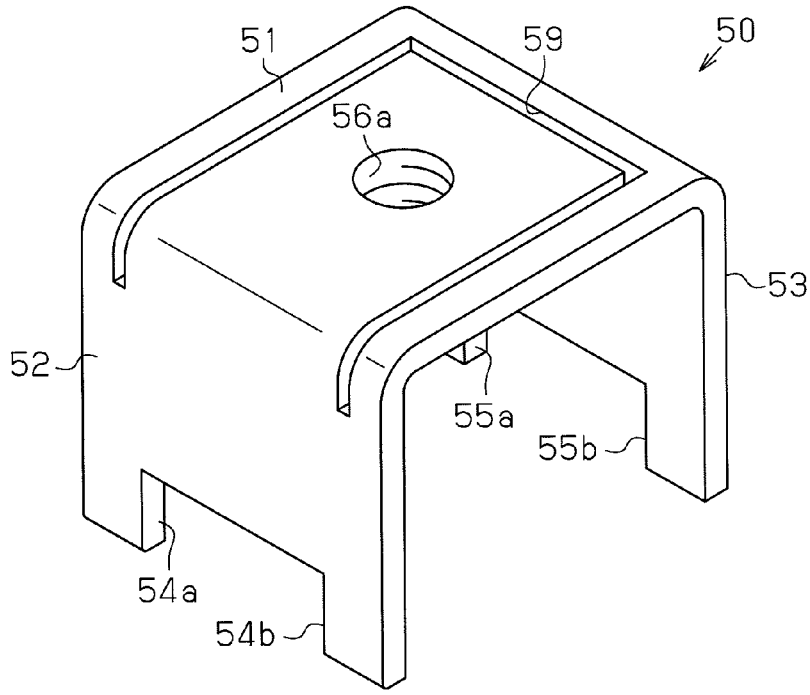
FIG. 7 is a perspective view showing a modification of a first connection terminal plate.

Instead of the slots 57 shown in FIG. 2, a U-shaped slot 59, or slit, may be formed in the first terminal base 50 as shown in FIG. 7. In this case, the portion surrounded by the slot 59 is movable in the vertical direction.

Figure 5A:
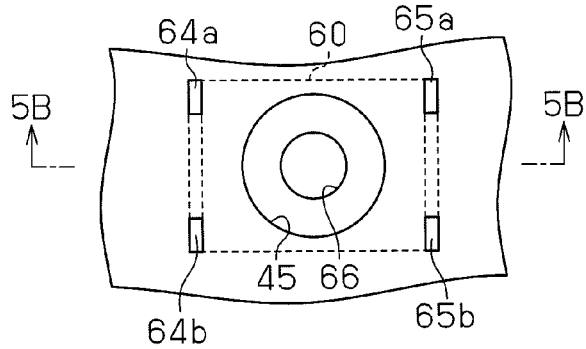
FIG. 5A is a plan view showing a component for a second printed substrate of FIG. 1B.
Figure 5B:
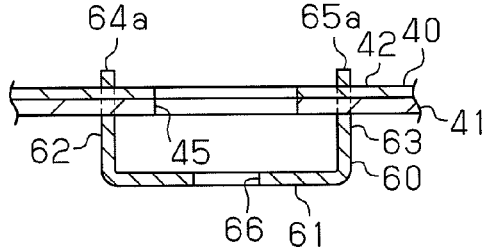
FIG. 5B is a cross-sectional view taken along line 5B-5B in FIG. 5A.
Figure 8A:
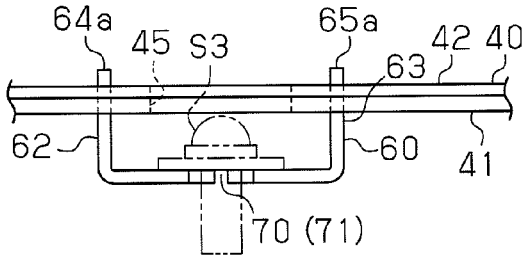
FIG. 8A is a front view showing a modification of a component for a second printed substrate in an electronic device.
Figure 8B:
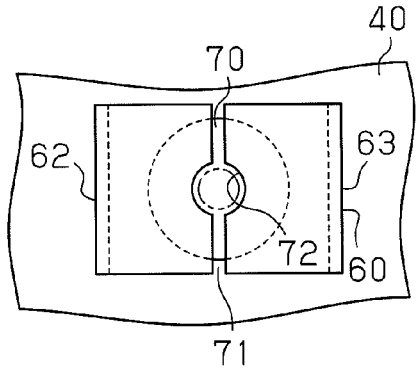
FIG. 8B is a bottom view showing the component of FIG. 8A.

Instead of the structure shown in FIGS. 5A and 5B, slits 70 and 71 may be formed in the second terminal base 60 as shown in FIGS. 8A and 8B. In this case, the slits 70 and 71 extend to a portion 72 through which the screw S3 passes. That is, the second terminal base 60 may be divided into two, a left portion and a right portion. The divided portions may each be independently fixed to the second terminal base 60. In this case, the slots 57 and 58 of the lower first terminal base 50 become unnecessary.

Figure 9A:
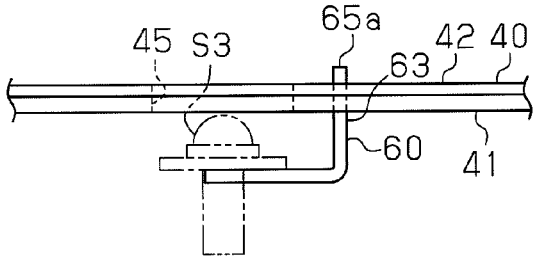
FIG. 9A is a front view showing a modification of a component for a second printed substrate in an electronic device.
Figure 9B:
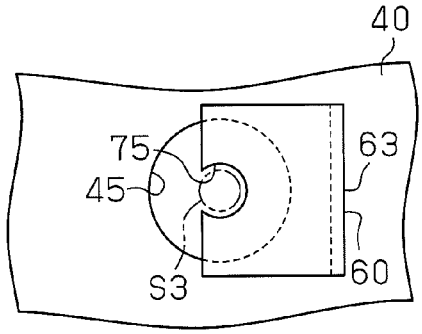
FIG. 9B is a bottom view showing the component of FIG. 9A.

In FIGS. 8A and 8B, the second terminal base 60 is divided into a left portion and a right portion. Instead, as shown in FIGS. 9A and 9B, a terminal base may be formed by only one of the left and right portions. In this structure, one of the left and right portions is fixed to the second printed substrate 40 and includes a screw insertion portion 75, through which the screw S3 extends.

Figure 10:
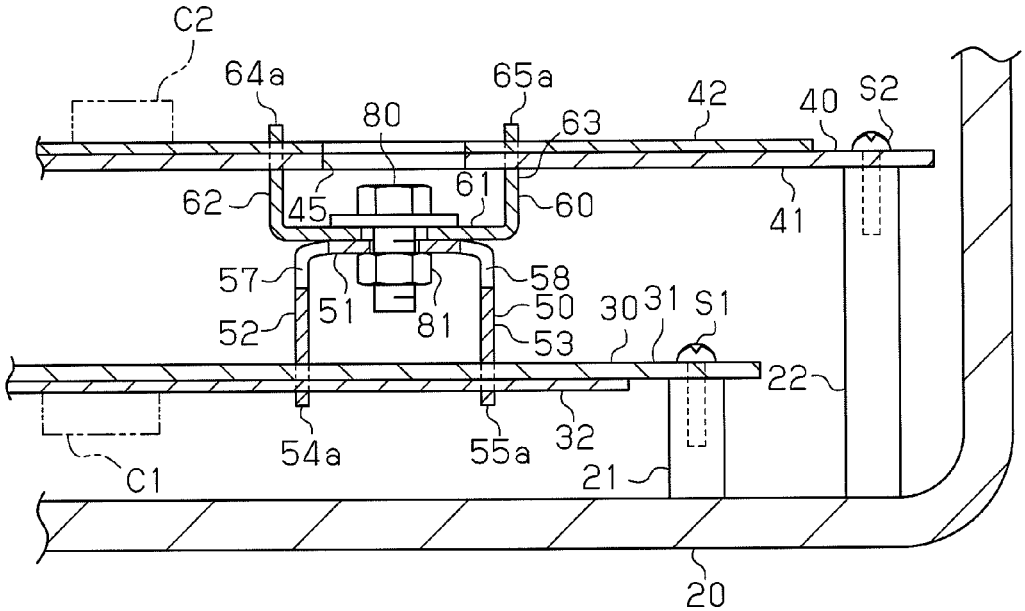
FIG. 10 is a cross-sectional view showing a modification of an electronic device.

In FIG. 1B, the screw S3 is engaged with the threaded hole 56*a* of the first terminal base 50. Instead, as shown in FIG. 10, a bolt 80 and nut 81 may be used as the fastening member. In this structure, the bolt 80 is extended through the first terminal base 50 and the second terminal base 60 and engaged with the nut 81 to fasten the first terminal base 50 and the second terminal base 60.

In FIG. 1B, the first terminal base 50 extends toward the second printed substrate 40, the second terminal base 60 extends toward the first printed substrate 30, and the terminal bases 50 and 60 are joined and fastened to each other between the first printed substrate 30 and the second printed substrate 40. The structure shown in FIG. 11 may be employed instead.

Figure 11A:
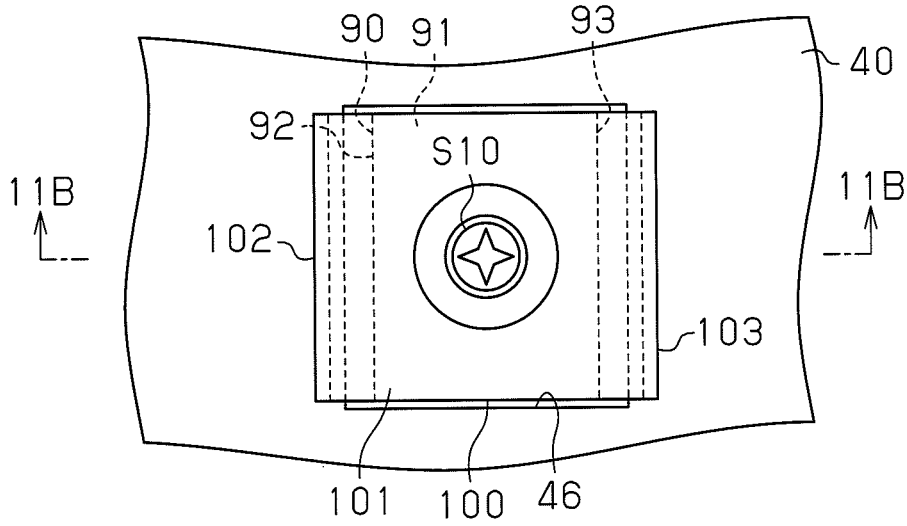
FIG. 11A is a plan view showing a modification of an electronic device.
Figure 11B:
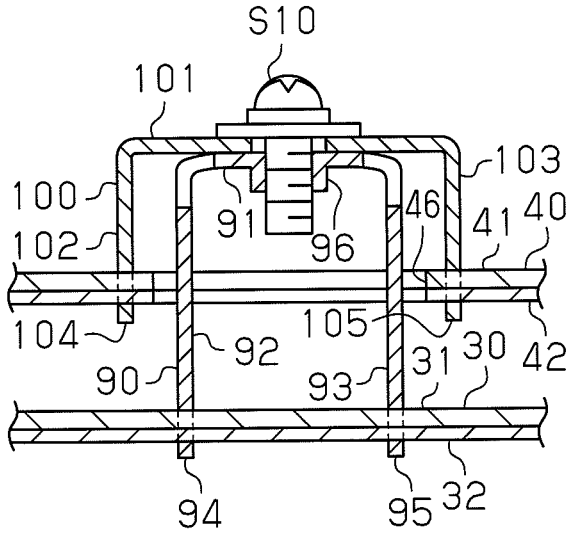
FIG. 11B is a cross-sectional view taken along line 11B-11B in FIG. 11A.

In FIG. 11, a first terminal base 90, which serves as a first connection terminal plate, is formed by bending a plate into a U-shape. The first terminal base 90 includes a horizontal portion 91, a first vertical portion 92, and a second vertical portion 93. The vertical portions 92 and 93 respectively include distal parts 94 and 95, which are fixed to the first printed substrate 30. A cylindrical portion 96, which includes a threaded hole, is formed in the central part of the horizontal portion 91. A through hole 46 is formed in the second printed substrate 40 at a portion corresponding to the horizontal portion 91 of the first terminal base 90. The first terminal base 90 is inserted through the insertion hole 46 of the second printed substrate 40, and the horizontal portion 91 is located above the second printed substrate 40.

A second terminal base 100, which serves as a second connection terminal plate, is formed by bending a plate into a U-shape. The second terminal base 100 includes a horizontal portion 101, a first vertical portion 102, and a second vertical portion 103. The vertical portions 102 and 103 respectively include distal parts 104 and 105 fixed to the second printed substrate 40. The second terminal base extends upward.

In a state in which the horizontal portion 91 is located below the horizontal portion 101, a screw S10 is inserted through the horizontal portion 101 and engaged with the cylindrical portion 96 to fasten the first terminal base 90 and the second terminal base 100.

The first substrate only requires a semiconductor element to be mounted on at least one of the two opposite surfaces. The second substrate also only requires a semiconductor element to be mounted on at least one of the two opposite surfaces. When semiconductor elements are mounted on opposite sides of an insulation substrate, a conductor is patterned on at least one surface of the insulation substrate.

The present examples and embodiments are to be considered as illustrative and not restrictive, and the invention is not to be limited to the details given herein, but may be modified within the scope and equivalence of the appended claims.

The invention claimed is:

1. A substrate connection structure comprising:

a first substrate including two opposite surfaces, wherein a semiconductor element is mounted on at least one of the two surfaces;

a second substrate facing the first substrate and including two opposite surfaces, wherein a semiconductor element is mounted on at least one of the two surfaces;

a first connection terminal plate extending away from the first substrate, wherein the first connection terminal plate includes a basal end, which is fixed to the first substrate, and a flat portion;

a second connection terminal plate extending away from the second substrate, wherein the second connection terminal plate includes a basal end, which is fixed to the second substrate, and a flat portion, and at least one of the flat portions includes a screw insertion portion; and a fastening member that fastens the first connection terminal plate and the second connection terminal plate through the screw insertion portion in a state in which the flat portions are in contact with each other.

2. The substrate connection structure according to claim 1, wherein one of the first and second connection terminal plates includes the screw insertion portion, the other one of the first and second connection terminal plates includes a threaded hole engaged with the fastening member, and the screw insertion portion is larger than the threaded hole.

3. The substrate connection structure according to claim 1, wherein at least one of the first and second connection terminal plates includes a tolerance accommodation portion that deforms to allow the first and second substrates to approach each other and accommodate tolerance.

4. The substrate connection structure according to claim 3, wherein the tolerance accommodation portion includes a slot formed in the corresponding connection terminal plate.

5. The substrate connection structure according to claim 1, wherein the first connection terminal plate includes a leg portion, which extends from the basal end toward the second substrate, and wherein the flat portion of the first connection terminal plate extends from a tip end of the leg portion parallel to the first substrate, and the second connection terminal plate includes a leg portion, which extends from the basal end toward the first substrate, and wherein the flat portion of the second connection terminal plate extends from a tip end of the leg portion of the second connection terminal plate parallel to the second substrate.

* * * * *